United States Patent [19]

Lin

[11] 4,346,495

[45] Aug. 31, 1982

[54] SEGMENTAL BRUSHING EQUIPMENT

[76] Inventor: Chung S. Lin, 46 Alley 21, Lane 99, Pei-Yuan St., Tainan, Taiwan

[21] Appl. No.: 107,539

[22] Filed: Dec. 27, 1979

[51] Int. Cl.[3] ..... A46B 5/00; B65D 21/00

[52] U.S. Cl. ..... 15/184; 15/244 R; 206/503; 206/509; 206/821; 215/10; 220/4 D

[58] Field of Search ..... 15/184, 244 R, 244 A, 15/244 B, 244 C, 104.93, 104.94, 106, 107, 114, 118, 159 A, 169; 220/4 C, 4 D; 206/616, 617, 620, 819, 820, 499, 501, 821, 503, 515, 509, 519, 620; 215/10; 401/34, 38, 39

[56] References Cited

U.S. PATENT DOCUMENTS

| | | | |
|---|---|---|---|
| 940,797 | 11/1909 | Fraser | 15/184 |
| 1,573,648 | 2/1926 | Sheely | 15/184 X |
| 2,273,559 | 2/1942 | Burnett | 15/184 |
| 2,645,375 | 7/1953 | Topfer | 220/4 D |
| 2,869,168 | 1/1959 | Morneault | 15/184 X |

*Primary Examiner*—Peter Feldman

*Attorney, Agent, or Firm*—Armstrong, Nikaido, Marmelstein & Kubovcik

[57] ABSTRACT

A brush device comprising a plurality of tubular units arranged in alignment and a cap to construct a column externally sealed by a sealing coat. The front end of each unit is provided with a brush head, and the portion around the brush head and the rear end of each unit respectively form the male part and female part of a socket joint, the male part being slightly longer than the female part, thus forming a slot at the junction of two adjacent units radially extending around the periphery of the column, which slot provides a guide to facilitate one to make a cut around this portion to remove an exhausted unit.

1 Claim, 7 Drawing Figures

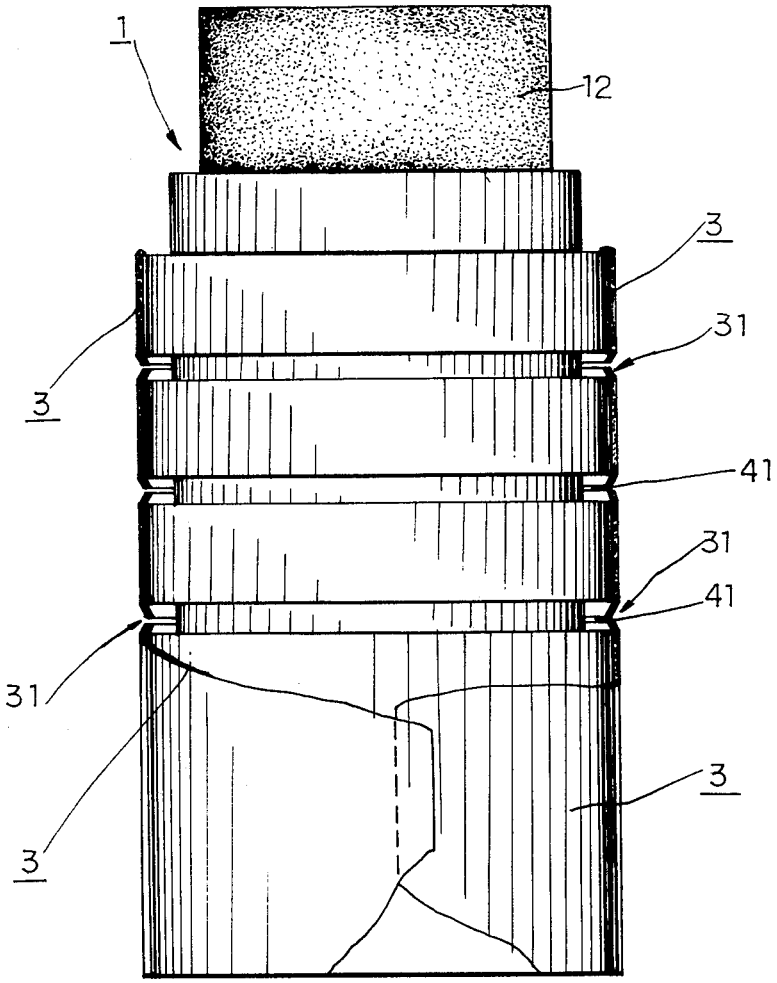
FIG. 6
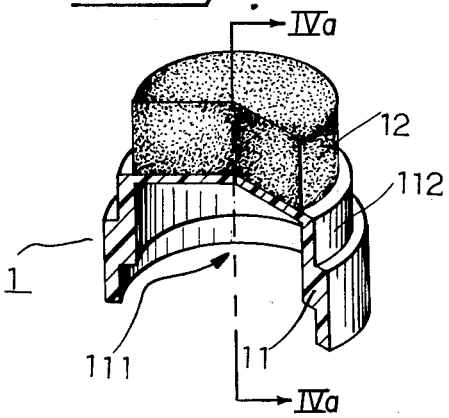
FIG. 4-b
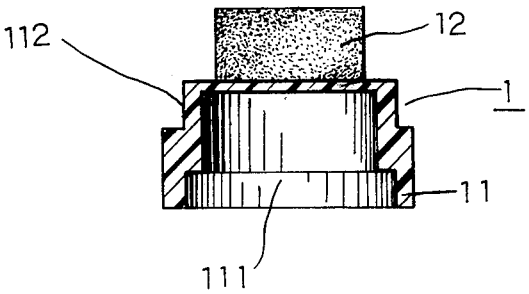
FIG. 4-a

SEGMENTAL BRUSHING EQUIPMENT

BACKGROUND OF THE INVENTION

It has been well known that the conventional styles of the cleaning and disposition of the surface of various utensils are mainly by directly scrubbing or wipping with brushes or mops, or by applying various coating materials such as detergents, polishing agents etc. to it. Since the brush and the coating material are different materials, both of them can be contaminated when applying the same coating material to different brushes, or applying same brush to different kinds of coating material A improved type of such equipment has been developed by combining a single brush head, ball or roller brush head, and container filled with coating material to construct an entity. However the most deadly defect lies in that all the coating material only provide a brush head. When the brush head is deformed, damaged, clogged, or accumulated by dirt, and if it can't be replaced or cleaned easily, the whole set will be discarded.

SUMMARY

The present invention relates to brushes, especially the ones which include a series of unit brush heads, that can be jointed together one by one and each member has a coating on their respective brush head. When the multiple unit brush heads and covers are built up as a column, it is enveloped tightly by a sealing coat and with cutting ditches on it for removing the exhausted or contaminated unit brush head. Thus, a new unit brush head is ready for use.

BRIEF DESCRIPTION OF THE DRAWINGS

FIG. 4*a* is the sectional view of a unit brush head;

FIG. 4*b* is the partial sectional view of a unit brush head;

FIG. 6 is the elevational view of the present invention.

DETAILED DESCRIPTION OF THE INVENTION

The present invention relates to brushes, especially to one that includes a series of unit brush heads that can be jointed in an array. Each unit brush head functions as an independent brush and can be replaced by a subsequent one when worn out or soiled. The object of the present invention is to overcome the defects mentioned previously. It involves an articulate column comprising a plurality of unit brush heads that can be jointed together one by one, and each member has coating material on their respective brush head. When the attached coating material is exhausted or contaminated, the brush head can be removed and substituted by a new one jointed behind.

Clearly speaking, the object of the present invention is to provide a brush equipment including backbone-like column composed of several unit brush heads connected together. Each unit brush head comprises a brush head at the front end and an internally recessed end which is structured to be adapted to receive the portion around the brush of the front end of the following unit. The space inside the unit is large enough to receive the whole brush head part. It is characterized in that the column built up by the plurality of unit brush heads and cover is enveloped tightly at least by a sealing coat longitudinally around it to construct a strong and firmly sealed structure formed by material which can tightly hold the units therein and can be cut by a nail of a user or edged objects.

The two ends of each unit respectively form the male part and female part of a socket joint to engage with the unit ahead of it or following behind. The length of the male part is longer than the female part. Thus, when engaged, the whole length of the male part is not nested in the female part, leaving a small length which forms a circular slot extending radially around the periphery of the column, whereby one can cut the sealing coat trimly about the junction of two adjacent units by, for example, his nails or edged objects, to remove the exhausted unit.

Figure 1:
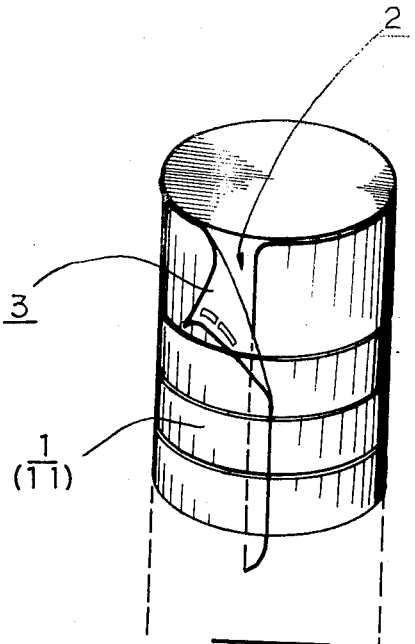
FIG. 1 is the partial perspective view of the present invention with the coat slightly peeled.
Figure 2:
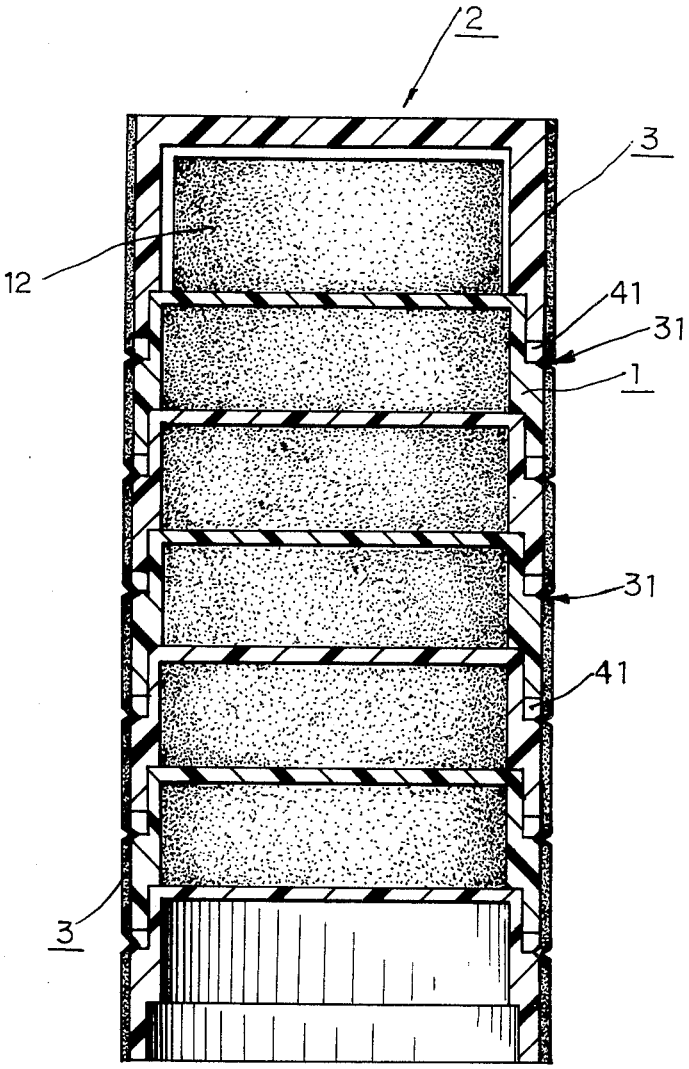
FIG. 2 is the sectional view of the present invention.

As shown in FIG. 1 the present invention comprises a plurality of unit brush heads (1) and a cover (2). A sealing coat (3) is adhered to the outer surface of the rear end (11) of unit brush head (1) and the cover (2), thus the brush equipment forms a firm and tightly sealed structure.

Figure 3:
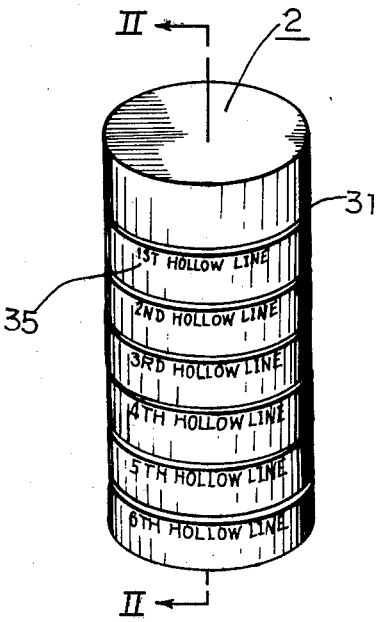
FIG. 3 is the perspective view of the present invention.
Figure 5:
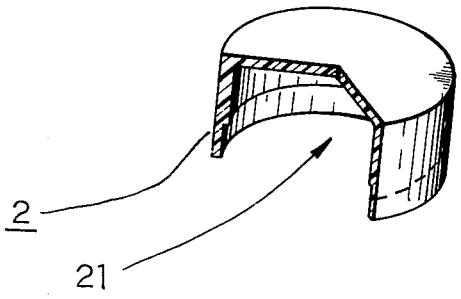
FIG. 5 is the partial sectional view of the cover.

One of the features of the present invention is the sealing coat (3) firmly sealing the outer surface of the connecting disc (11) of unit brush head (1) and the cover (2). The marks (35) on the sealing coat (3) can help the users to remove the unit brush head (1). In a embodiment as shown in FIG. 4*a* and FIG. 4*b*, it is obvious that at the rear end (11), the invention forms a female part (111) of a socket joint, the portion around the brush head (12) forming the male part (112) thereof. A feature of the joint resides in that the axial length of the male part (112) is slightly longer than that of the female part (111). Thus when two units are engaged together, a circuit slot (31) extending radially around the assembly is formed. At each position corresponding to a slot (41), the sealing coat (3) is provided with a cutting site (31) along which one can make a trim cut with his fingernail or an edged object easily to detach the unit from the remaining ones. The cutting site (31) is a narrow circular depression of the sealing coat above the circular slot. Referring to FIG. 3, each unit can be externally provided with a mark (35) indicating the order of the units whereby one can know the number of the units at a glance. FIG. 4*a* and FIG. 4*b* respectively show the sectional view and cutaway view of a brush unit, in which the coating material can be held in the brush head (12). The cover (or cap) (2) of this invention is provided with a rear end substantially of the same structure and size as the rear end of a unit, so as to be adapted to fit to the first brush unit. In other words it forms a female part (21) of the socket joint previously mentioned, corresponding to what the reference numeral (11) designates. As shown in FIG. 6, the adjacent part of the sealing coat (3) is still firmly sealed on the outer surface of the removed brush unit. According to the marks (35) on the sealing coat (3), one can easily use each unit brush head (1) in sequence. It can be brought from place to place easily without the risk of contamination of the coating material therein. It is indeed a valuable and practical invention.

The selection of the material for the brush head covers a broad range, and we can choose suitable ones depending on what condition and occasion it is applied.

However the selection of highly absorptive material such as sponge is preferable, because it can greatly enhance the effect of the invention.

The variety of sealing coat is also manifold. Material such as waterproof paper, tin foil or various kinds of plastic film . . . etc. are all satisfactory.

The present invention has thus been described in details and the description referes only to one of its embodiment. Any alternation and modification within the scope of the spirit of the present invention should be included within the claim for patent herein.

I claim:

1. A segmented brush device comprising: a plurality of brush units sequentially coupled together in an end-to-end manner to form a cylindrical column, wherein an annular slot is formed between adjacent brush units; a cover for covering the first of said brush units; a sealing coat completely surrounding said brush units and said cover, said sealing coat having depressions therein, said depressions partially extending into said annular slots wherein:

a rear end of each said brush unit includes a female portion and a front end of each said brush unit includes a male portion, said male portion being longer than said female portion in the axial direction thereof and wherein the male portion of said brush units if fitted into the female portion of an adjacent brush unit for sequentially coupling said units and said slot is formed therebetween, the width of said slot being equal to the difference in length between said male portion and said female portion.

* * * * *